US010577231B1

(12) United States Patent
Peel

(10) Patent No.: US 10,577,231 B1
(45) Date of Patent: Mar. 3, 2020

(54) BLOCK AND TACKLE

(71) Applicant: Albert Peel, Pittsfield, NH (US)

(72) Inventor: Albert Peel, Pittsfield, NH (US)

( * ) Notice: Subject to any disclaimer, the term of this patent is extended or adjusted under 35 U.S.C. 154(b) by 0 days.

(21) Appl. No.: 16/105,166

(22) Filed: Aug. 20, 2018

Related U.S. Application Data

(60) Provisional application No. 62/553,737, filed on Sep. 1, 2017.

(51) Int. Cl.
*B66D 3/06* (2006.01)

(52) U.S. Cl.
CPC ..... *B66D 3/06* (2013.01)

(58) Field of Classification Search
CPC ..... B66D 3/04; B66D 3/06; B66D 3/08
See application file for complete search history.

(56) References Cited

U.S. PATENT DOCUMENTS

| | | | | | |
|---|---|---|---|---|---|
| 113,688 | A * | 4/1871 | Norcross | B66D 3/04 | 254/409 |
| 147,625 | A * | 2/1874 | Floyd | A62B 35/04 | 188/65.1 |
| 524,403 | A * | 8/1894 | Rowland | A62B 35/04 | 188/65.1 |
| 756,747 | A * | 4/1904 | Walton | B66D 1/36 | 254/408 |
| 785,358 | A * | 3/1905 | Gutenkunst | A62B 35/04 | 188/65.1 |
| 1,671,435 | A * | 5/1928 | McKissick | B66D 3/046 | 254/402 |
| 2,139,605 | A * | 12/1938 | Schat | B66D 3/06 | 254/401 |
| 6,189,867 | B1 * | 2/2001 | O'Rourke | B66D 3/04 | 254/391 |
| 7,287,303 | B2 * | 10/2007 | Yang | B66D 3/04 | 24/134 R |

* cited by examiner

*Primary Examiner* — Sang K Kim
*Assistant Examiner* — Nathaniel L Adams
(74) *Attorney, Agent, or Firm* — Keeley DeAngelo LLP; W Scott Keeley

(57) ABSTRACT

A compact and efficient block-and-tackle apparatus.

17 Claims, 2 Drawing Sheets

BLOCK AND TACKLE

TECHNICAL FIELD

The invention relates in general to lifting and pulling apparatuses and specifically to a compact block-and-tackle system.

BACKGROUND

A block and tacky: is an apparatus comprising a set of pulleys in combination with a single, continuous, linear-tension member for amplifying the tension force in the linear-tension member. A linear-tension member is the tackle in the block-and-tackle combination and is commonly referred to as a line, rope or cord. In one common configuration a first block houses one pulley on a single axle while a second block houses two pulleys on a single axle. The first block is removably engaged with a load. A cord is fixedly engaged with the first block; runs around a first pulley in the second block, then around the single pulley in the first block; following around the second pulley in the second block and then on to the pulling force. In this manner the pulling force is amplified.

An ideal block and tackle provides a mechanical advantage that may be described by the following equation:

$$\frac{F_B}{F_A} = n,$$

Where $F_A$ is the tensile force applied to the cord, $F_B$ is the load and n is the number of rope sections. In other words, the block and tackle reduces the pulling force by a factor n. A block and tackle with an n factor of 6 will require six units of cord to be pulled to move the load a distance equal to one unit of cord.

One skilled in the art understands that there are efficiency losses in any system and that an ideal system expresses the overall function of a mechanical apparatus. One skilled in the art also understands that there are many variations to a block-and-tackle system with varying numbers of pulleys per block. Variations in the number of pulleys vary the n factor. In a common configuration, the block with the free end of the tackle is mounted to a structure and is referred to as the stationary block, while the second block is attached to the object to be lifted and is referred to as the moving block. In this configuration the pulling force is in the opposite direction of the movement of the object being lifted. One skilled in the art understands that switching the location of the blocks results in a pulling force that is in the same direction as the movement of the object being lifted.

SUMMARY

A compact block-and-tackle apparatus that employs efficient configuration of components and materials to provide a relatively high lift capacity.

Housings provide attachment for mounting members, locations for pulleys, and attachments for tackle. In some embodiments the housings are machined aluminum. In an example embodiment, specific contours of the housing components, in combination with spacers and collars, provide a configuration in which common roller bearings suffice as pulleys. In some embodiments, a cleat is engaged with one of the blocks such that the cord may be pulled or locked in the cleat to hold the cord fast.

Other objects and features will become apparent from the following detailed description considered in conjunction with the accompanying drawings. The drawings serve to illustrate rather than define the limits of the invention.

BRIEF DESCRIPTION OF THE DRAWINGS

To assist those of skill in the art in making and using the disclosed apparatus, reference is made to the accompanying figures, wherein.

DESCRIPTION

Figure 1:
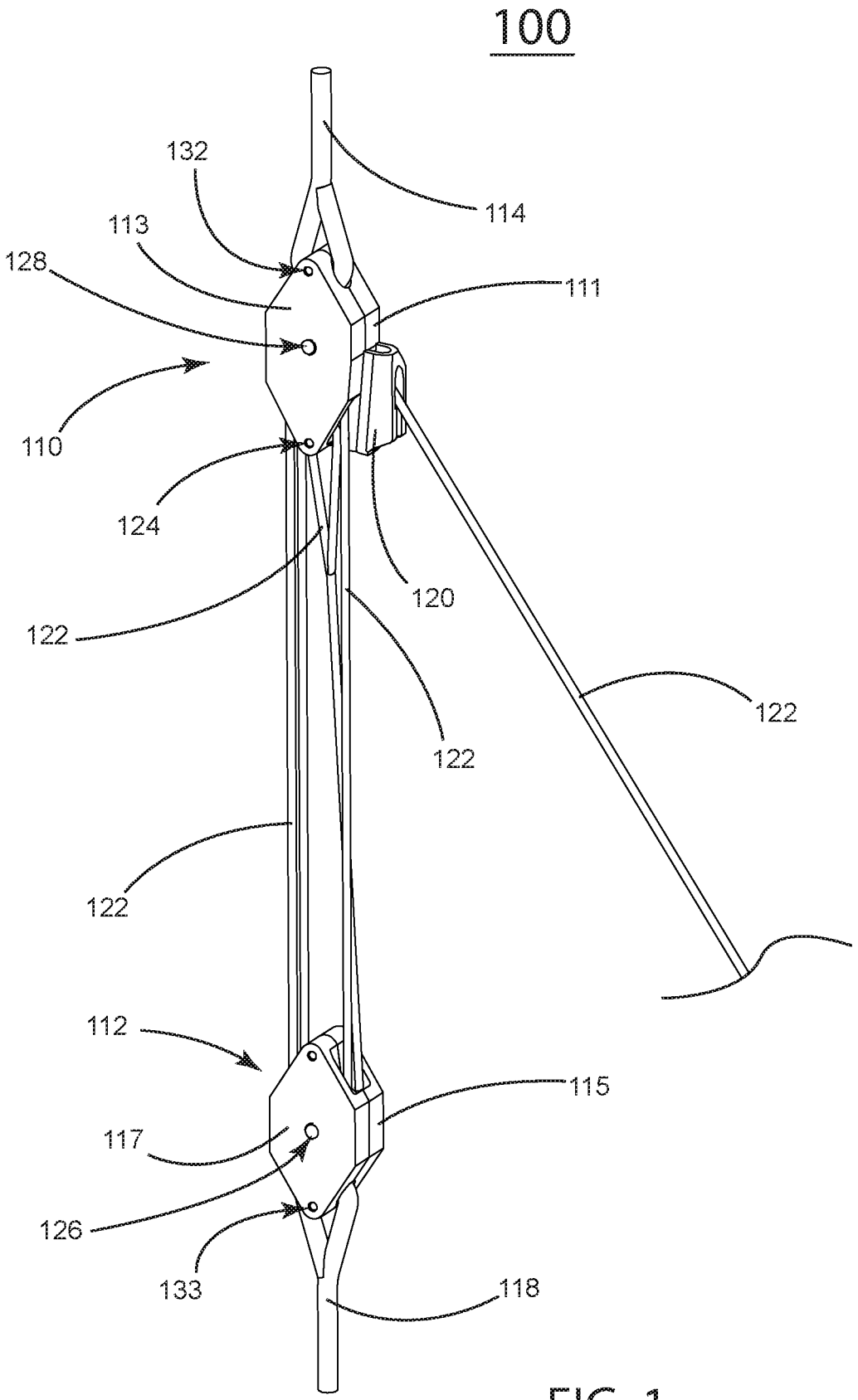
FIG. 1 is a perspective view of an example embodiment of the present disclosure.
Figure 2:
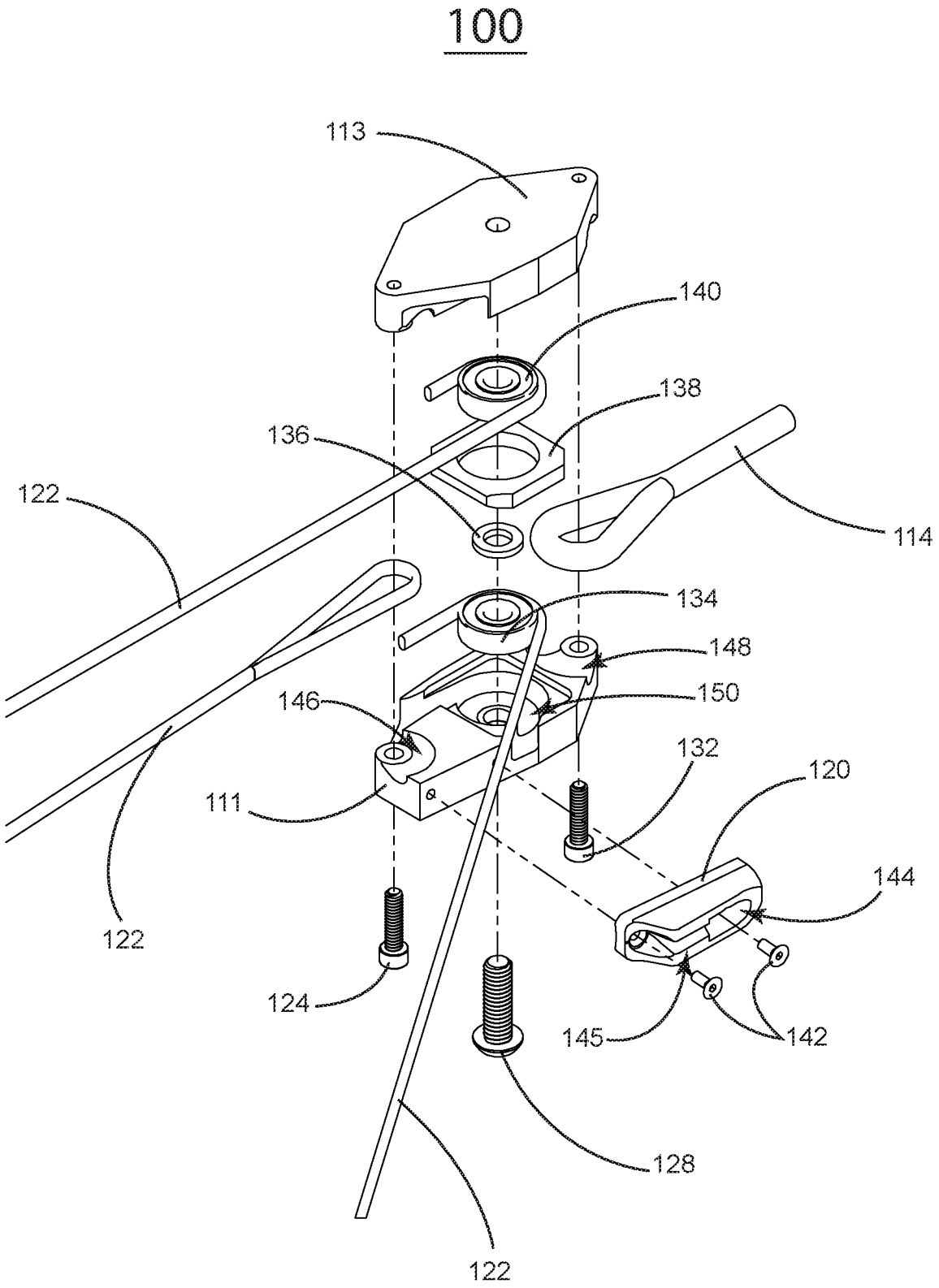
FIG. 2 is a perspective, exploded view of the embodiment of FIG. 1.

FIG. 1 shows a perspective view of an example embodiment 100. A first block 110 is comprised of a front portion 113 and a back portion 111 that together make up the block 110. A cleat 120 is fixedly engaged with the block 110. The block 110 is fixedly engaged with a mounting member 114 that passes through the block and surrounds a fastener 132. In this manner the fastener 132 engages block portions 113 and 111 while providing structure to engage the mounting member 114. A fastener 128 engages block portions 113 and 111 while providing an axle for pulleys 134 and 140 (FIG. 2). A length of cord FIG. 1, 122, also referred to as tackle, is affixed to the lower portion of the first block 110. The cord is looped through a portion of the block portions and fastener 124. In this manner the fastener 124 engages the block portions 113 and 111 while providing structure to engage the cord 122.

A second block 112 is comprised of portions 117 and 115. The second block 112 is fixedly engaged with a load-carrying member 118 that passes through the block and surrounds a fastener 133. In this manner the fastener 133 engages the block portions 117 and 115 while providing structure to engage the carrying member 118. A fastener 126 engages block portions 117 and 111 while providing an axle for pulleys similar to pulleys 134 and 140 (FIG. 2). The cord FIG. 1, 122 passes through the second block 112 and around internal pulleys. One skilled in the art understands the function of block pulleys and their relatively similar arrangement in each block as illustrated in FIG. 2.

In FIG. 2, an exploded, perspective view illustrates the internal components of the embodiment 100. Block portion 113 engages block portion 111 by fasteners 124, 128 and 132. Fasteners 124 and 132 have two purposes: they hold block portions 113 and 111 together and also provide structure to hold cord 122 and mounting member 114, respectively, to the block FIG. 1, 110. Fastener FIG. 2, 128 holds block portions 113 and 111 together, while also providing an axle for bearings 134 and 140. A roller bearing 140 provides both rotational movement about the fastener/axle 128 and also functions as a pulley for cord 122. A collar 138 keeps the cord 122 from slipping off of the bearing/pulley 140 while in motion. A washer 136 keeps bearing/pulley 140 spaced away from bearing/pulley 134. The view of block portion 111 shows a machined groove 146 that provides a fastening location for the cord 122, a machined groove 148 that provides a fastening location for the mounting member 114 and a machined indentation 150 that provides a location for bearing/pulley 134. The machined groove 146 is an annular groove surrounding a through-hole for a fastener 124 and is contoured to receive the cord 122. The machined groove 148 is an annular groove surrounding a through-hole for a fastener 132 and is contoured to receive the mounting member 114. The machined indentation 150 may also be understood as an annular recess that surrounds a through-hole. The contour of the annular recess is designed to accommodate the bearing/pulley 134 and may have specific countours to meet the surfaces of the parts of the bearing/pulley 134 such as the inner race, outer race and collet. One skilled in the art understands that these machined grooves and the indentation are mirrored in block portion 113.

A cleat 120 is affixed to block portion 111 with fasteners 142. The cleat 120 has a hole with portions 144 and 145 that is shaped such that a first area of the opening 144 allows the cord 122 to pass through while a second, narrower portion 145 to hold the cord 122.

These embodiments should not be construed as limiting but rather additions and modifications to what is expressly described herein. The features of the various embodiments described herein are not mutually exclusive and can exist in various combinations and permutations, even if such combinations or permutations are not made express herein, without departing from the spirit and scope of the invention.

The invention claimed is:

1. An apparatus for lifting comprising:
a first block and a second block; and
a length of tackle having a fixed end and a moving end; and
a mounting member; and
a carrying member; and
a cleat; and
at least four roller bearings; and
the first block comprising:
a first block front portion and a first block rear portion; and
a first block top end and a first block bottom end; and
a first annular groove surrounding a through-hole proximal to said first block top end; and
said mounting member residing in and fixedly engaged with said first annular groove; and
a second annular groove surrounding a through-hole proximal to said first block bottom end; and
said fixed end of said tackle residing in and fixedly engaged with said second annular groove; and
at least one fastener, engaging said first block front portion to said first block rear portion; and
said at least one fastener providing an axle for at least a first roller bearing and a second roller bearing; and
the length of tackle looping over said first roller bearing and looping again over said second roller bearing; and
the second block comprising:
a second block front portion and a second block rear portion; and
a second block top end and a second block bottom end; and
a third annular groove surrounding a through-hole proximal to said second block bottom end; and
said carrying member residing in and fixedly engaged with said third annular groove; and
at least one fastener, engaging said second block front portion to said second block rear portion; and
said at least one fastener providing an axle for at least a third roller bearing and a fourth roller bearing; and
the length of tackle looping over said first roller bearing following over said third roller bearing and the loop over said second roller bearing following over said fourth roller bearing; wherein
pulling said moving end of said tackle draws said first block toward said second block and thus said carrying member toward said mounting member, with a magnified pulling force as the tackle rolls over said roller bearings.

2. The apparatus of claim 1 further comprising:
at least a second fastener through said through-hole surrounded by said first annular groove proximal to said first block top end; and
at least a third fastener through said through-hole surrounded by said second annular groove proximal to said first block bottom end; wherein
said second fastener and said third fastener fixedly engage said first block front portion and said first block rear portion.

3. The apparatus of claim 1 further comprising:
at least a fourth fastener through said through-hole surrounded by said third annular groove proximal to said second block bottom end; wherein
said fourth fastener fixedly engages said second block front portion and said second block rear portion.

4. The apparatus of claim 1 wherein said tackle is parachute chord.

5. The apparatus of claim 1 wherein said first block and said second block are of machined aluminum.

6. The apparatus of claim 1 wherein said first block and said second block are of machined steel.

7. The apparatus of claim 1 wherein said first block and said second block are of cast aluminum.

8. The apparatus of claim 1 wherein said first block and said second block are of cast iron.

9. An apparatus for lifting comprising:
a first block and a second block; and
a length of tackle having a fixed end and a moving end; and
a mounting member; and
a carrying member; and
a cleat; and
the first block comprising:
a first block front portion and a first block rear portion; and
a first block top end and a first block bottom end; and
said mounting member fixedly engaged with said first block top end; and
at least one fastener, engaging said front portion to said rear portion; and
said at least one fastener providing an axle for at least a first roller bearing and a second roller bearing; and
the fixed end of said length of tackle fixedly engaged with the first block bottom end of said first block front and first block rear portions; and
the length of tackle looping over said first roller bearing and looping again over said second roller bearing; and
the second block comprising:
a second block front portion and a second block rear portion; and
a second block top end and a second block bottom end; and
at least one fastener, engaging said second block front portion to said second block rear portion; and
said at least one fastener providing an axle for at least a third roller bearing and a fourth roller bearing; and the carrying member fixedly engaged with the second block bottom end of said second block front and second block rear portions; and the length of tackle looping over said first roller bearing following over said third roller bearing and the loop over said second roller bearing following over said fourth roller bearing; and a first frustoconical annular recess partially residing in said first block front portion and partially residing in said first block rear portion, the frustoconical annular recess surrounding said first roller bearing and said second roller bearing outer race, leaving space for said tackle to travel over said first roller bearing; and a second frustoconical annular recess partially residing in said second block front portion and partially residing in said second block rear portion, the second frustoconical annular recess surrounding said third roller bearing and said fourth roller bearing outer race, leaving space for said tackle to travel over said second roller bearing;

a first surface between said first roller bearing and said second roller bearing; and said first surface having a first central hole; and said first central hole coaxial with said at least one fastener; and a second surface between said third roller bearing and said fourth roller bearing; and said second surface having a second central hole; and said second central hole coaxial with said at least one fastener in said second block;

wherein pulling said moving end of said tackle draws said first block toward said second block with a magnified pulling force as the tackle rolls over said roller bearings, and said first frustoconical annular recess is configured to sufficiently surround said first roller bearing outer race and said second roller bearing outer race such that the tackle may move over said first and second roller bearing and not fall between a roller bearing and a proximal surface of the first block, and the second frustoconical annular recess is configured to sufficiently surround said third roller bearing outer race and said fourth roller bearing outer race such that the tackle may move freely over said third and fourth roller bearing and not fall between a roller bearing and a proximal surface of the second block, and said first surface provides a guide for said tackle preventing tackle from falling between said first roller bearing and said second roller bearing; and said second surface provides a guide for said tackle preventing tackle from falling between said third roller bearing and said fourth roller bearing.

10. The apparatus for lifting of claim 9 further comprising:

a cleat having a portion for moving tackle through the cleat and a portion for affixing tackle in said cleat; and said cleat fixedly engaged with said first block; wherein the tackle passes through said cleat and may be moved through the cleat or may be affixed in the cleat for holding the first block and second block in a fixed position relative to each other.

11. The apparatus for lifting of claim 9 further comprising:

a first spacer between said first roller bearing and said second roller bearing; and a second spacer between said third roller bearing and said fourth roller bearing.

12. The apparatus for lifting of claim 9 further comprising:

a first annular groove surrounding a through-hole proximal to said first block top; and the first annular groove surrounding and fixedly engaging with said mounting member; and at least a second fastener through said through-hole for engaging said first block front portion and said first block rear portion.

13. The apparatus for lifting of claim 9 further comprising:

a second annular groove surrounding a through-hole proximal to the first block bottom; and the second annular groove surrounding and fixedly engaging with said fixed end of said tackle; and at least a third fastener through said through-hole for engaging said first block front portion and said first block rear portion.

14. The apparatus for lifting of claim 9 further comprising:

a third annular groove surrounding a through-hole proximal to the second block bottom; and the third annular groove surrounding and fixedly engaging with said carrying member; and at least a fourth fastener through said through-hole for engaging said second block front portion and said second block rear portion.

15. The apparatus of claim 9 wherein said tackle is parachute chord.

16. The apparatus of claim 9 wherein said first block and said second block are of machined aluminum.

17. The apparatus of claim 9 wherein said first block and said second block are of machined titanium.

* * * * *